United States Patent [19]

Evans

[11] 4,366,353

[45] Dec. 28, 1982

[54] ANTI-PARALLELING APPARATUS FOR HIGH-VOLTAGE GEAR

[75] Inventor: David M. Evans, Panama City Beach, Fla.

[73] Assignee: S&C Electric Company, Chicago, Ill.

[21] Appl. No.: 237,228

[22] Filed: Feb. 23, 1981

[51] Int. Cl.[3] ..... H01H 31/00

[52] U.S. Cl. ..... 200/48 R; 200/48 KB; 200/50 R; 200/324

[58] Field of Search ..... 200/48 R, 48 P, 48 KB, 200/5 R, 5 B, 50 R, 50 C, 50 A, 318, 323, 335, 337, 153 G

[56] References Cited

U.S. PATENT DOCUMENTS

| | | | |
|---|---|---|---|
| 3,697,709 | 10/1972 | Witkor | 200/48 R |
| 3,876,847 | 4/1975 | Dykes et al. | 200/50 A |
| 4,142,078 | 2/1979 | Kaluaitis | 200/48 R |
| 4,308,441 | 12/1981 | Evans et al. | 200/48 KB |

FOREIGN PATENT DOCUMENTS

| | | | |
|---|---|---|---|
| 742880 | 1/1956 | United Kingdom | 200/337 |

*Primary Examiner*—Willis Little
*Attorney, Agent, or Firm*—John D. Kaufmann

[57] ABSTRACT

Apparatus for preventing two switches from being simultaneously closed. A pair of rollers are each movable in, and between the ends of, respective curved tracks. The rollers are each linked to a respective switch so that when its switch is closed, each roller is at the bottom of its track, and when its switch is open, each roller is at the top of its track. Each switch cannot operate if its roller cannot move. A yoke maintains the rollers a fixed distance apart so that each roller may be at the top of its track, one roller may be at the top of its track while the other roller is at the bottom of its track, and vice versa, but one roller cannot move away from the top of its track if the other roller is not at the top of its track and vice versa. If one switch attempts to close while the other switch is closed, the roller of the closed switch is pulled into a detent at the bottom of its track; the roller remains in the detent as long as the other switch attempts closure. The closed switch may reopen while its roller remains in the detent, preventing closure of the one switch until its attempt at closure ceases. If the switches attempt simultaneous closure, one roller is preferentially held at the top of its track, while the other roller moves to the bottom of its track.

12 Claims, 8 Drawing Figures

ANTI-PARALLELING APPARATUS FOR HIGH-VOLTAGE GEAR

BACKGROUND OF THE INVENTION

1. Field of the Invention

The present invention relates to improved anti-paralleling apparatus for high-voltage switchgear and, more particularly, to improved apparatus in high-voltage switchgear for preventing simultaneous closure of two switches, which apparatus is simple and inexpensive to fabricate and associate with the switches, exhibits improved operation, and requires little space. The anti-paralleling apparatus of the present invention is an alternative to the apparatus described and claimed in commonly-assigned, co-pending U.S. patent application, Ser. No. 201,684, filed Oct. 29, 1980. The apparatus of the present invention is especially useful with switchgear containing two switches which are mounted in a so-called back-to-back configuration, as shown in commonly-assigned, co-pending U.S. patent application Ser. No. 136,632, filed Apr. 1, 1980. The anti-paralleling apparatus of application Ser. No. 201,684 is more conveniently used in high-voltage switchgear having two switches mounted side-by-side.

2. Background of the Invention

A wide variety of high-voltage switchgear is available. Such switchgear often contains first and second three-phase switches. Each switch may be in series with a respective alternating high-voltage power source, one of which may be used as a preferred power source, the other of which may be used as an alternate power source. The switches may be connected to a common bus within the switchgear. The common bus is connected to loads or other downstream devices intended to be powered by one of the sources. Normally, the first switch, in series with the preferred power source, is closed to energize the loads connected to the bus, while the second switch, in series with the alternate power source, is open. Should the preferred power source experience an interruption in service, or should it become otherwise necessary or desirable to connect the alternate power source to the loads, the normally closed first switch is opened and the normally open second switch is closed. These switch operations—opening or closing—may be effected by manual or motorized operating mechanisms. The latter may be automatically responsive to the condition and availability of the power sources and may be remotely operable.

Usually, the preferred and alternate power sources are totally separate and are not electrically associated. This, of course, assures that even if one of the sources experiences difficulty, there is a high probability that the other source is available for powering the loads connected to the common bus. However, the separation and disassociation of the sources also leads to their being electrically dissimilar at any given instant in time. In brief, the preferred and alternate sources are electrically out of phase. For this reason, it is undesirable that both switches be simultaneously closed. Simultaneous closure of the switches parallels the sources via the common bus. Because the sources are out of phase, paralleling them will effect current flow therebetween, an undesirable condition which can damage the sources, the gear, the loads, or the interconnections thereamong.

An overall object of the present invention, then, is the provision of improved apparatus which prevents the simultaneous closure of two separate switches in high-voltage switchgear. Specifically, this apparatus should positively prevent one switch from closing if the other switch is closed. The apparatus should also prevent the switches from closing at the same time.

Anti-paralleling apparatus of the various configurations and types are known in the art. Many are expensive or difficult to fabricate or to associate with the switches. Others are unreliable in operation, are quite complicated, or require substantial amounts of room within the switchgear. Anti-paralleling apparatus which is wholly or primarily electrical in nature and which depends for proper operation on drawing power from the power sources, is often deemed undesirable. Such undesirability arises from the possibility that one or both sources may become inoperative or unavailable while the need or desire to prevent simultaneous switch closure remains. Anti-paralleling apparatus which is electrical may alternatively be powered by a local power source, such as a local battery. Proper operation of the apparatus, therefore, depends on the availability and integrity of the local power source, which may be difficult to ensure.

Accordingly, a further object of the present invention is the provision of inexpensive, reliable totally mechanical anti-paralleling apparatus which does not depend on the presence of electrical power for proper functioning.

Other types of wholly mechanical anti-paralleling apparatus are known. Certain types of such anti-paralleling apparatus prevent simultaneous closure of the switches. However, if the first switch is closed when the second switch attempts to close (which it cannot because of the functioning of the anti-paralleling apparatus), the second switch may subsequently close in response to the first switch reopening. This occurrence is peculiar to switchgear having operating mechanisms which, once activated, continue to apply a closing force to their associated switches. The continuously applied force applied to the second switch is effective to close it immediately upon the first switch reopening. Electrically, this closure may not be deleterious to the power source, the switchgear, or the loads, because only one switch is closed. However, it may be desirable to prevent closure of the second switch whenever the second switch attempts to close while the first switch is closed and the second switch continues this attempt through the time the first switch reopens. Preventing closure of the second switch in this instance may be desirable until there has been some intervention following the reopening of the first switch. For example, a workman may approach the switchgear while the first switch is closed and the second switch is open; the workman may not know that the operating mechanism for the second switch is applying a continued closing force thereto. The workman may manually open the first switch not realizing that this has resulted in the second switch closing and in the common bus remaining energized. The workman's contact with the common bus or with items connected thereto—which he believes to be de-energized—could prove injurious to him.

Accordingly, yet another object of the present invention is the provision of anti-paralleling apparatus which positively prevents a closure of the second switch if the first switch is closed and which also prevents closure of the second switch after the first switch reopens if the operating mechanism for the second switch attempted to initiate closure thereof (which was initially prevented by the apparatus) and continues to attempt to initiate closure through the time the first switch reopens.

SUMMARY OF THE INVENTION

With the above and other objects in view, the present invention relates to improved apparatus used in high-voltage switchgear for preventing a first two-position switch and a second two-position switch from simultaneously occupying their second positions. The first position of each switch may be the open position, and the second position of each switch may be the closed position.

The improved apparatus according to the invention includes a first and a second driven member. The driven members are constrained to move along respective curvilinear paths between extreme first and second locations. A first link is associated at its first end with the first switch; a second link is associated at its first end with the second switch. Each link is associated with its respective switch for reciprocation of a second end thereof in a first direction when its switch moves from the first to the second position and in a second opposite direction when its switch moves from the second to the first position. Each switch is unable to move if its associated link is prevented from moving. The second end of the first link is connected to the first driven member; the second end of the second link is connected to the second driven member. Each link is connected to its driven member so that when its associated switch moves from the first to the second position, the link and its second end reciprocate in the first direction to move the associated driven member from the first to the second location. Further, each link and its second end reciprocate in the second direction when the associated switch moves from the second to the first position. The driven members are maintained a fixed distance apart. The maintenance of this fixed distance achieves three ends. First, both driven members can simultaneously occupy their first locations and, accordingly, both switches can simultaneously occupy their first positions. Second, either driven member can occupy its second location while the other driven member occupies its first location and, accordingly, either switch can move to and occupy its second position while the other switch is in its first position. Third, either driven member is prevented from moving out of its first location while the other driven member is not in its first location, and, accordingly, neither switch can move out of its first position despite a momentary or continued attempt to so move while the other switch is not in its first position.

According to a general embodiment of the invention, movement of either switch from its second to its first position reciprocates its associated link and the respective second end thereof in the second direction, and simultaneously therewith the associated driven member is moved from its second to its first location, notwithstanding the occurrence of a momentary or continued attempt of the other switch to move from its first to its second position. If a continued attempt of the other switch to move from its first to its second position is extant, the other switch moves to its second position after the one switch reaches its first position.

In a preferred embodiment of the present invention, movement of one switch from the second to the first position and the consequent reciprocation of the associated link and the second end thereof in the second direction effects the ultimate movement of the associated driven member to its first location only in the absence of a continued attempt of the other switch to move from its first to its second position. If, on the other hand, there is present a continued attempt to move the other switch from its first to its second position, the driven member associated with the one switch remains in its second location after the one switch returns to its first position.

In yet another preferred embodiment, if both switches attempt to move from their first to their second positions at the same time, a selected one of the driven members is prevented from moving out of its first location while the other driven member is permitted to move to its second location.

DETAILED DESCRIPTION

Anti-paralleling apparatus 10 according to the present invention is depicted in FIGS. 1–4. The apparatus 10 is an alternative to the anti-paralleling apparatus depicted and claimed in commonly-assigned co-pending U.S. patent application, Ser. No. 201,684 filed Oct. 29, 1980, and is conveniently usable with high-voltage switchgear of the type depicted in commonly-assigned, co-pending U.S. patent application, Ser. No. 136,632 filed Apr. 1, 1980 in the names of Evans and Swanson. The type of high-voltage switchgear with which the anti-paralleling apparatus 10 of the present invention is intended to be used is not described in detail herein; reference should be had to the aforementioned application Ser. No. 136,632 for further details of the switchgear.

Figure 1:
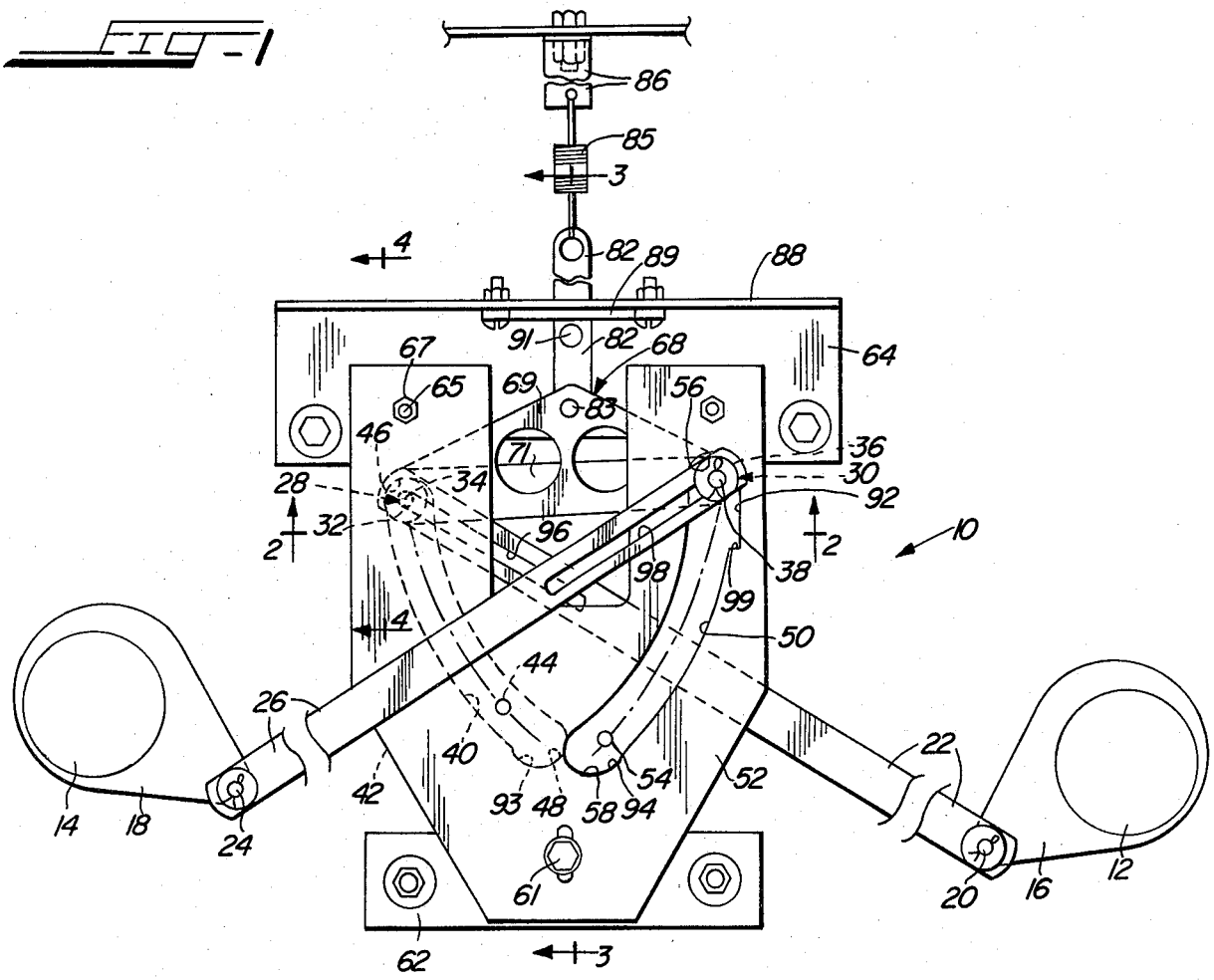
FIG. 1 is a front elevation of improved anti-paralleling apparatus according to the present invention.
Figure 2:
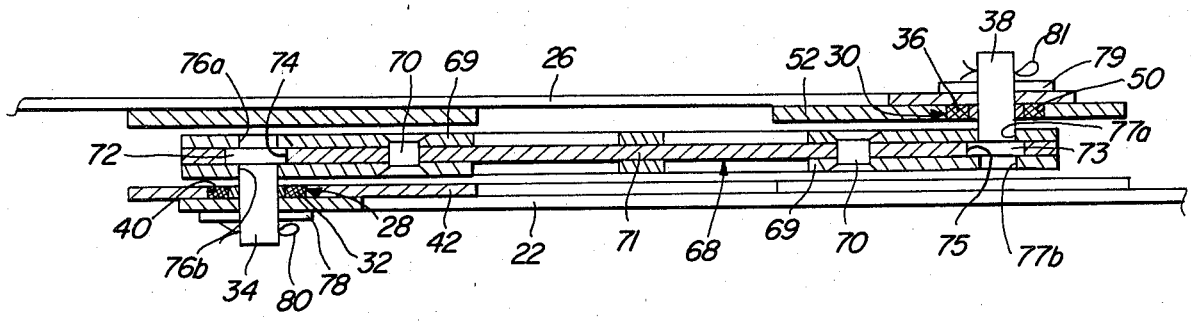
FIG. 2 is a partially sectioned view of the apparatus depicted in FIG. 1 taken along line 2—2 in FIG. 1.

Referring to FIG. 1, typical high-voltage switchgear with which the anti-paralleling apparatus 10 of the present invention may be used includes first and second, two-position, three-phase, high-voltage switches (not shown) mounted back-to-back in an enclosure (not shown). Each high-voltage switch includes three sets of stationary contacts (not shown) and three switchblades (not shown); each phase or pole of the switches includes one switchblade and one stationary contact set. The three switchblades of the first switch are mounted to a common, rotatable, insulative strut, generally indicated at 12 in FIG. 1. The three switchblades of the second switch are similarly mounted to a second strut 14. Selective rotation of the struts 12 and 14 rotates the switchblades carried thereby into and out of engagement with the stationary contact sets for closing or opening the switches. As shown in FIG. 1, back-to-back mounting of the switches results in the struts 12 and 14 being separated and generally parallel. Side-by-side mounting of the switches, as in application Ser. No. 201,684, results in similar struts being co-axially aligned.

The struts 12 and 14 may be rotated by separate first and second operating mechanisms (not shown) which may be manual or automatic. The former type of operating mechanism is manipulable by a human operator, such as by the rotation of a hand crank or the like, to rotate the struts 12 and 14 either directly or by the release of energy stored in response to crank rotation. The latter type of switch operating mechanism is typically motorized and either directly, or by the release of energy stored in response to motor energization, rotates the struts 12 and 14, depending on the condition of a circuit to which the switchgear is connected or on the receipt of a remote signal. Either type of operating mechanism may function in one of two ways relevant to the functioning of the apparatus 10. Specifically, if the operating mechanism is unable to operate its associated switch for any reason, either the mechanism may permit the switch to remain in its extant position while discontinuing the attempt to rotate the strut 12 or 14, or it may continue the attempt to rotate the strut 12 or 14. The former manner of functioning is referred to herein as a "momentary attempt" to operate the switch. The latter manner of functioning is referred to herein as a "continued attempt" to operate the switch and is typically found in operating mechanisms which rotate the struts 12 and 14 by the release of energy previously stored in a robust spring or the like.

The stationary contact sets of one switch may be connected to a first set of common buses and the stationary contact sets of the other switch may be connected to a second set of common buses. Usually, corresponding buses of the first and second common bus sets are electrically interconnected by main buses which are, in turn, connectable to electrical loads. The switchblades of one switch are usually connected to a preferred source of electrical power while the switchblades of the other switch are connected to an alternate source of electrical power. Normally, then, the switch connected to the preferred source of electrical power is closed, while the switch connected to the alternate source of electrical power is open. In this condition, electrical power is supplied to the loads connected to the main buses from the preferred source. Should something untoward occur in or to the first source, or should it be otherwise desirable to remove the preferred source from the loads while continuing to energize the loads, the normally closed switch is opened and the normally open switch is closed. This action supplies electrical power to the loads from the alternate source.

Usually, the preferred and alternate sources are separate and independent, both electrically and physically. The reason for this, of course, is that should trouble be experienced with either source, there is a high probability that the other source is available to supply power to the loads. The independence of these sources, of course, leads to their being out of phase electrically. Consequently, it is undesirable that both switches be simultaneously closed, as this would electrically parallel the two out-of-phase sources relative to the main buses and could cause damage to the sources, to the gear, to the switches, or to the interconnections among them. This desire to prevent the two sources from being in electrical parallel relative to the main bus leads to the apparatus 10 being referred to as "anti-paralleling apparatus." It should be understood that although the apparatus 10 of the present invention is so denoted and, preferably prevents both switches from being closed at the same time, the apparatus 10 may also be used with any pair of two-position switches where it is desired to prevent the switches from simultaneously occupying one of their two positions.

The first strut 12 is connected to and rotated by the first switch operating mechanism while the second strut 14 is connected to and rotated by the second switch operating mechanism. The first strut 12 has connected thereto for rotation therewith a first crank 16 and the second strut 14 has connected thereto a second crank 18. Each strut 12 or 14 and its respective crank 16 or 18 may be directly interconnected as generally illustrated, or they may be interconnected by linkages, as should be obvious. Regardless of the type of connection between the struts 12 and 14 and their cranks 16 and 18, it is preferred that the cranks 16 and 18 be located in the vicinity of each other, for example, within some portion of the enclosure for the switchgear. For purposes of the present discussion, it is assumed that both struts 12 and 14 and their cranks 16 and 18 assume the positions shown in FIG. 1 when their associated switches are open. Further, it will be assumed that closure of the first switch occurs when the first strut 12 is rotated counterclockwise; thus, the first crank 16 rotates counterclockwise when the first switch moves from open to closed and clockwise when the first switch moves from closed to open. Similarly, when the second switch closes, the second strut 14 and the crank 18 rotates clockwise; when the second switch opens, the second strut 14 and the crank 18 rotate counterclockwise. As noted previously, the apparatus 10 of the present invention may be used to prevent two switches from simultaneously occupying either of their two positions and, accordingly, in a more general sense, the positions assumed by the struts 12 and 14 by the cranks 16 and 18 in FIG. 1 may be denominated first positions, whether the switches are open or closed. The second position of the strut 12 and the crank 16 is the position it assumes following counterclockwise rotation, whereas the second position of the strut 14 and the crank 18 is the position it assumes following clockwise rotation. For purposes of illustration only, movement of the struts 12 and 14 and of the cranks 16 and 18 between the open and closed positions (or between the first and second positions) involves approximately 55° of rotation thereof. As should be obvious, both the direction of rotation of the struts 12 and 14 (and of the cranks 16 and 18) and the amount of this rotation may be adjusted to suitably accommodate any type of switch.

The first crank 16 is pivotally connected as by a pin 20 or the like to a first elongated link 22. The second crank 18 is similarly connected by a pin 24 to a second elongated link 26. At an end remote from its connection to the crank 16, the first link 22 is associated with a first driven member 28 in a manner to be described in more detail below. Similarly, the second link 26 is associated with a second driven member 30. The first driven member 28 comprises a roller 32 mounted for rotation on a pin 34. The second driven member 30 similarly includes a roller 36 on a pin 38.

The roller 32 of the first driven member 28 rides in a track 40 formed through a rear plate 42. The track 40 constrains the roller 32 and, accordingly, the first driven member 28 to follow a first curvilinear path 44. The roller 32 may occupy a first extreme location (upper) 46 on the path 44 and a second location (lower) 48 on the path 44. Preferably, the diameter of the roller 32 is only slightly smaller than the width of the track 40 so that the roller 32 is substantially constrained to move along the path 44. The roller 36 moves in a track 50 formed in a front plate 52 in a manner similar to the movement of the roller 32 in the track 40. Thus, the roller 36 and the second driven member 30 are constrained to move along a second curvilinear path 54 between an extreme first location (upper) 56 and an extreme second location (lower) 58 on the path 54.

Figure 3:
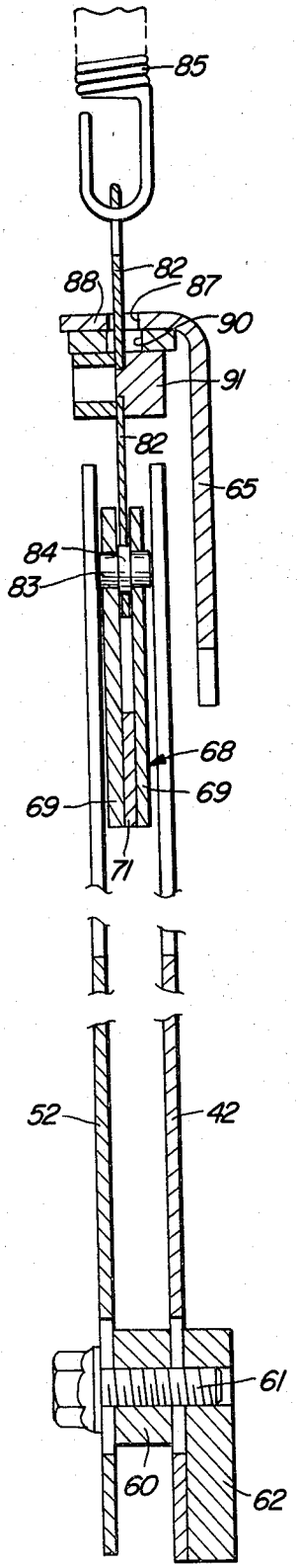
FIGS. 3 and 4 are side elevation, partially-sectioned views of the apparatus depicted in FIG. 1 and taken along lines 3—3 and 4—14, respectively, in FIG. 1.
Figure 4:
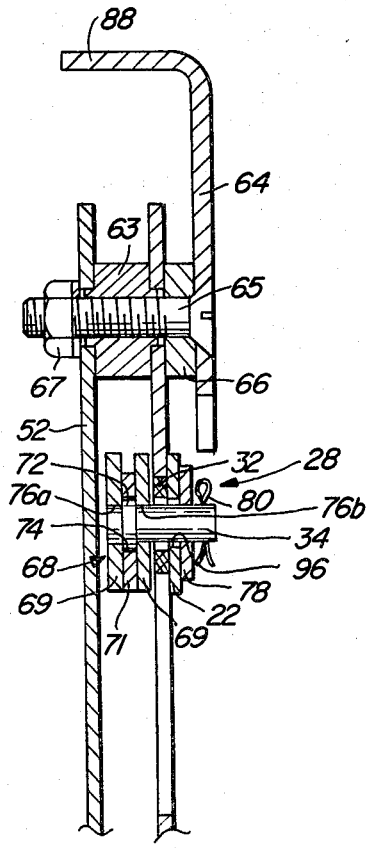

The plates 42 and 52 are mounted in overlying, overlapping relationship as follows. As shown in FIGS. 1 and 3, the lower portions of the plates 42 and 52 are spaced apart by an appropriate spacer 60. A bolt 61 is first run through the plates 42 and 52 and the spacer 60 is then threaded into a tapped hole of a lower mounting member 62. As shown in FIGS. 1 and 4, the upper portions of the plates 42 and 52 are spaced apart at two places by spacers 63. Screws 64 are inserted through an upper mounting member 65 at two places and are run through spacers 66, the two plates 42 and 52, and the spacers 63. Nuts 67 are then run onto the screws 64. The apparatus 10 may be mounted between and in the vicinity of the cranks 16 and 28 by attaching the mounting members 62 and 65 to a side wall (not shown) of the enclosure for the high-voltage switchgear.

The length, configuration, and orientation of the paths 44 and 54 are selected so that the fixed distance between the first locations 46 and 56 is the same as (a) the fixed distance between the first location 46 and the second location 58, and (b) the fixed distance between the first location 56 and the second location 48. Similarly, the distance between the first location 46 (or 56) of the path 44 (or 54) and any point of the path 54 (or 44) other than the first and second locations 56 and 58 (or 46 and 48), is less than the just-described selected distance. Preferably, the paths 44 and 54 are circular, being spaced apart between their first locations 46 and 56 by the selected distance and having their second locations 48 and 58 nearly overlapping as viewed in FIG. 1. The path 44 may lie on a circle having its center at the first location 56 of the path 54, while the path 54 may lie on a circle having its center at the first location 46 of the path 44.

A yoke 68 maintains or fixes the first and second driven members 28 and 30 apart by the previously described selected distance. The yoke 68 may take any convenient configuration, one preferred configuration being illustrated in FIGS. 1–4.

The yoke 68 comprises two similar triangular plates 69 located one behind the other. Sandwiched between the plates 69 which are held together by rivets 70 is a lock plate 71. As best shown in FIGS. 3 and 4, the yoke 68 is movably positioned between the plates 42 and 52. The pins 34 and 38 have respective enlarged portions 72 and 73 which are conformally held in appropriate holes 74 and 75 formed through the lock plate 71. The smaller diameter portions of the pins 34 and 38 on either side of the enlargements 72 and 73 are conformally held in holes **76*a* and 76*b* and 77*a* and 77*b* formed through the plates 69. The enlargement 72 of the pin 34 is held in the hole 74 of the plate 71 by the plates 69; the pin 34 extends to the rear of the structure shown in FIG. 1. The roller 32 is mounted on the rearwardly extending portion of the pin 34 for free rotation thereon and this portion of the pin 34 also extends through the link 22, as hereinafter described. Similarly, the pin 38 is held in the lock plate 71 between the plates 69 and extends forwardly to support the roller 36; the pin 38 passes through the link 26. The links 22 and 26 may be maintained in association with the pins 34 and 38 by washers 78 and 79 held in place by cotter keys 80 and 81**.

The top or apex of the yoke 68 is pivotally connected to one end of a bias link 82 by a pin 83 extending between the plates 69 and is prevented from longitudinal movement by an enlarged central portion 84 trapped therebetween. A robust tension spring 85 is connected between the other end of the bias link 82 and a bracket 86 mountable to a wall of the enclosure for the switchgear. The bias link 82 passes through a slot 87 formed in a flanged portion 88 of the mounting member 65. Connected to the underside of the flange 88 may be a shock absorbing layer 89 through a slot 90 in which the bias link 82 also passes. Mounted through the bias link 82 is a stop pin 91, impact of which with the layer 89 prevents the bias link 82 from assuming a position any higher than that depicted in FIG. 1.

In preferred embodiments, one of the tracks, say the track 50 formed through the plate 52, contains a widened notch 92 at or near the first location 56. Also preferably, at or near the second locations 48 and 58 of both tracks 40 and 50 there are formed respective widened detent notches 93 and 94. Further, in preferred embodiments, the bias link 82 is connected to the yoke 68 asymmetrically or slightly off center, that is, the pin 83 is closer to the pin 38 than to the pin 34. Furthermore, the first location 56 of the track 50 is slightly higher than the first location 46 of the track 40. The reasons for, and the function of, this structure of preferred embodiments is explained below.

Conveniently, the cranks 14 and 18 rotate substantially in a common plane and the apparatus 10 is generally co-planar therewith. The link 22 is connected between the crank 14 and the pin 34 with the roller 32 thereon and crosses the path 54 behind the rear plate 42. Similarly, the link 26 is connected between the crank 18 and the pin 38 with the roller 36 thereon and crosses the path 44 in front of the plate 52 at the front of the apparatus 10. The cranks 14 and 18 assume the positions shown in FIG. 1 when their associated switches are both open. Accordingly, both rollers 32 and 36 are located at their respective first locations 46 and 56 when their respective switches are open. Because the crank 16 rotates counterclockwise when its switch moves from open to closed, and because the crank 18 rotates clockwise when its switch moves from open to closed, closing movement of either switch places its associated link 22 or 26 in tension. Similarly, movement of either switch from its closed to its open position places its associated link 22 or 26 in compression.

A simplified embodiment of the present invention will now be described; such description ignores, for the time being, the presence of the notches 92, 93 and 94, the asymmetrical connection of the bias link 82 to the yoke 68, and the higher positioning of the first location 56 of the path 54. For purposes of this simplified description, it will be assumed that the pins 34 and 38 are fixed to the ends of their respective links 22 and 26, and, accordingly, elongated slots 96 and 98 formed respectively in the links 22 and 26 and through which the pins 34 and 38 respectively pass will also for the time being be ignored.

Figure 5:
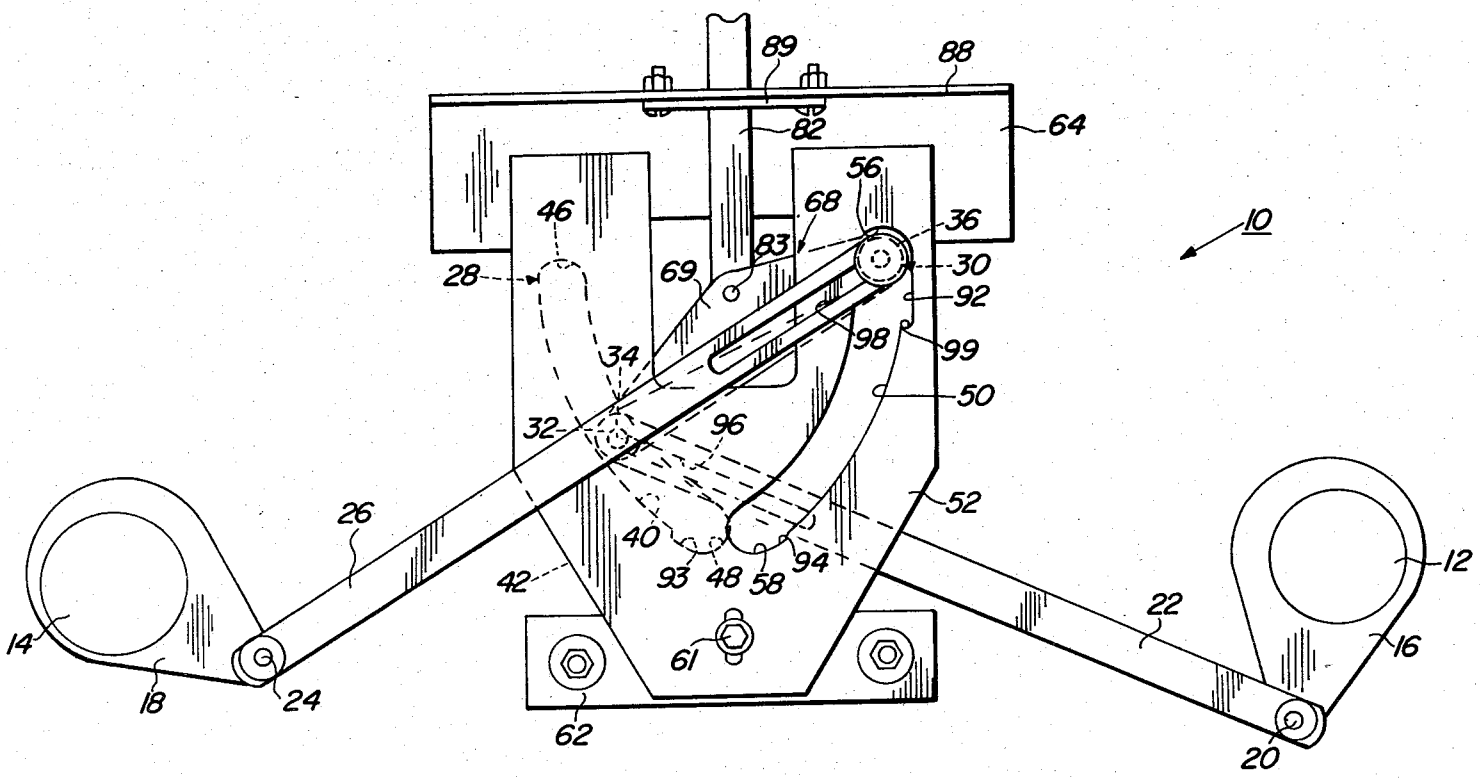
FIGS. 5–8 are views similar to FIG. 1 showing the condition of the apparatus of FIG. 1 at various times during the operation thereof.

As already noted, when the switches are open, their respective cranks 14 and 18 assume the positions shown in FIG. 1 and the rollers 32 and 36 are each located at their respective first locations 46 and 56. As shown by going from FIG. 1 to FIGS. 5 and 6, should the first switch move from open to closed, the link 22 is put in tension and the roller 32 is moved along the path 44 in the track 40 (FIG. 5) until it reaches its second location 48 (FIG. 6), at which time the first switch is closed. Such movement of the roller 32 causes the roller 32 and the yoke 68 to rotate counterclockwise about the pin 38 as a center. Rotation of the yoke 68 about the pin 38 as a center moves the bias link 82 downwardly and elongates the spring 85. When elongated, the spring 85 biases the yoke 68 back toward the position depicted in FIG. 1, but is unable to move it there due to the second switch being in its closed position. With the first switch closed, it is now assumed that the second switch attempts to close. The attempt to close the second switch rotates the crank 18 slightly clockwise, placing the link 26 in tension. The tensioned link 26 attempts to move the pin 38 and the roller 36 clockwise along the track 50, but the roller 36 cannot so move because any location other than its first location 56 would move the roller 36 closer to the roller 32 than is permitted by the yoke 68. Because the roller 36 cannot move, the link 26, the crank 18 and the strut 14 cannot move. Accordingly, if the first switch is closed, the second switch cannot close and remains open.

As noted previously, switch operating mechanisms are of two general types: one which ceases attempting to operate its switch if that proves impossible ("momentary attempt") and another which continuously attempts to operate its switch even though the switch cannot operate ("continued attempt"). If the switch operator attempting to close the second switch is of the first type, reopening the first switch moves the roller 32 from its second location 48 back to its first location 46 along the path 44, and the roller 36 remains in its first location 56. Since the attempt to close the second switch was a momentary attempt and has ceased, both switches are now open and both rollers 32 and 36 are in their first locations 46 and 56. The attempt to close the second switch may be a continued attempt and may persist from the time the roller 32 is in its second location 48 until the time the roller 32 returns to its first location 46. In this event, upon the roller 32 reaching its first location 46, the tension continuously applied to the link 26 now reciprocates the link 26 to move the roller 36 downwardly in the track 50 and along the path 54 until it reaches the second location 58. At this point in time, the first switch is open and the second switch is closed. If an attempt is now made to close the first switch, such attempt will be blocked for reasons similar to those described above and the first switch will either remain open or will immediately close upon the return of the roller 36 to its first location 56, depending on the type of switch operating mechanism associated therewith.

The above description covers the apparatus 10 of the present invention in its most simple form. This description does not take into account the facts that (a) both switches may attempt to move from their open positions to their closed positions simultaneously or (b) it may be desirable to prevent closure of one of the switches which attempted, but was unable, to close because the other switch was closed, the closing attempt of the one switch continuing through the time that the other switch reopened. As noted earlier, it may be desirable to prevent this closure of the one switch in order to prevent unexpected energization of the main bus or of other parts of the switchgear. The invention in its preferred, more specific forms deals with both of these operational problems.

In a first preferred specific embodiment, the apparatus 10 functions so as to prevent closure of one switch which was subjected to a continued attempt at closure from the time the other switch was closed through the time the other switch returns to its open position. This specific preferred embodiment relates to the notches 93 and 94 and to the slots 96 and 98 respectively formed through the links 22 and 26. The slots 96 and 98 are configured so as to receive the respective pins 34 and 38 therein and to permit both rotation of the rollers 32 and 36 on the pins 34 and 38, as well as free relative motion between the links 22 and 26 and the respective pins 34 and 38.

Figure 6:
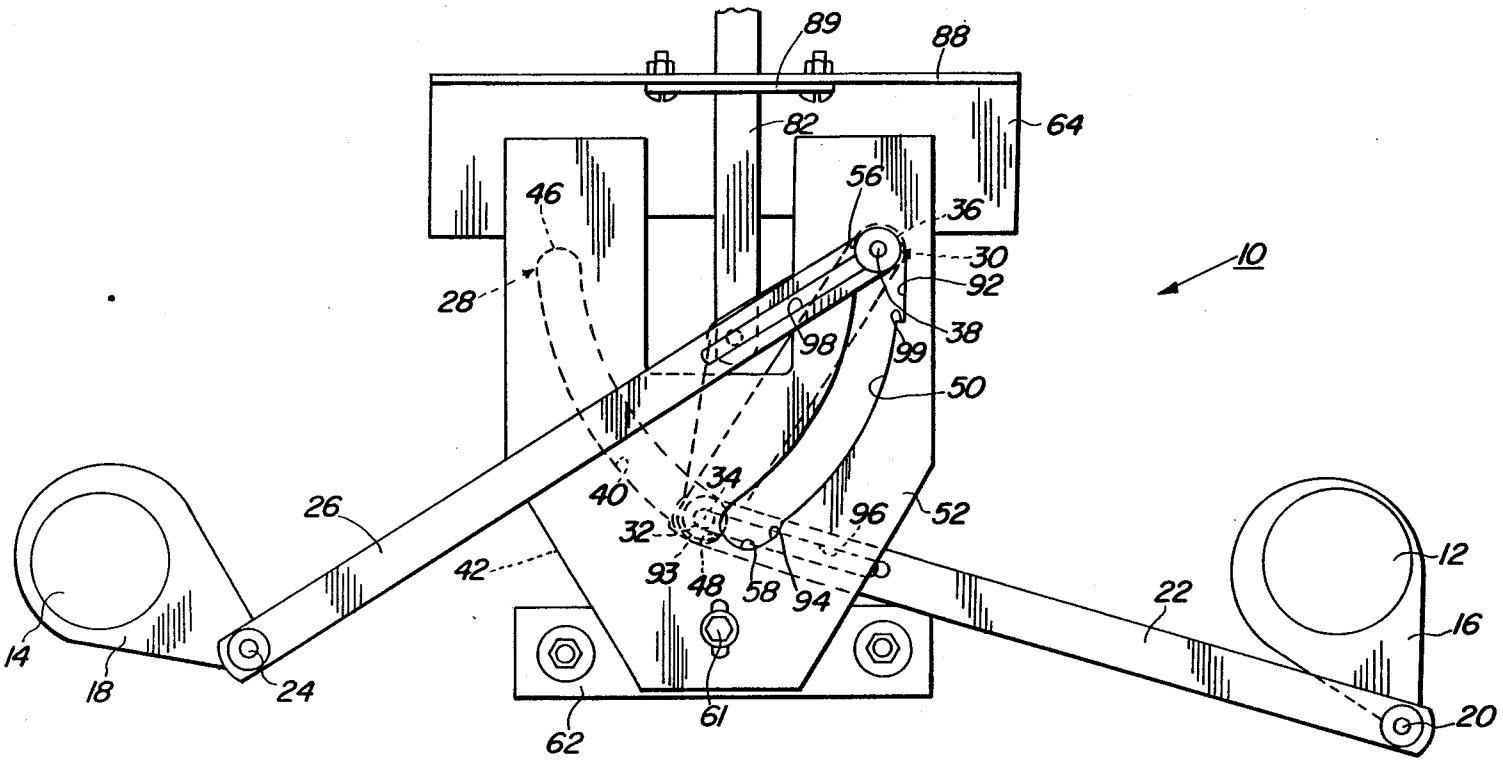
Figure 7:
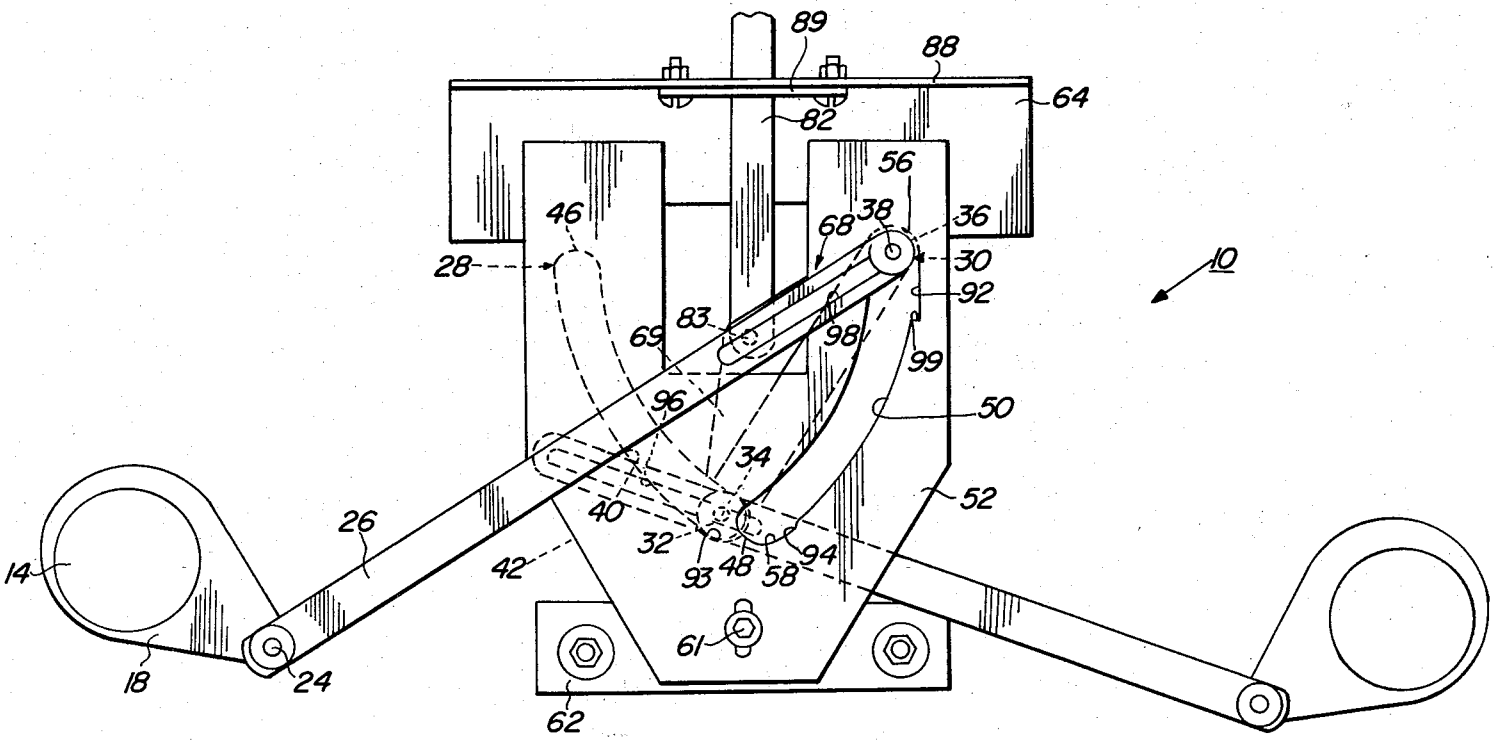

It is first assumed that both switches are open and the cranks 14 and 18, the links 22 and 26, and the rollers 32 and 36 have the positions shown in FIG. 1. Thus, the pin 34 is positioned at the left end of the slot 96, while the pin 38 is positioned at the right end of the slot 98. If the first switch moves from open to closed, the crank 16 rotates counterclockwise, as previously described, to tension the link 22 and to move the roller 32 from its first location 46 (FIG. 1) to its second location 48 (FIG. 6). Because the link 22 is in tension, the pin 34 remains at the left end of the slot 96. Should the second switch remain open and not be subjected to a continued attempt to close, reopening of the first switch is achieved by clockwise rotation of the crank 14. Clockwise rotation of the crank 14 attempts to put the link 22 into compression, but because of the slot 96, the first link 22 moves relatively with respect to the pin 34, that is, leftwardly and slightly upward. The length of the slot 96 is selected so that the first switch may fully open without bringing the right end of the slot 96 into contact with the pin 34. See FIG. 7. Although the right end of the slot 96 does not urge the roller 32 out of its second position 48, the extended spring 85 biases the yoke 68 back to the position shown in FIG. 1, thus moving the roller 32 back to its first location 46 as the link 22 reciprocates leftwardly. The combined actions of clockwise rotation of the crank 14, leftward reciprocation of the link 22, and upward movement of the yoke 68 by the spring 85 ultimately result in the link 22 and the roller 32 reassuming the positions depicted in FIG. 1.

Assume now, however, that while the first switch was closed and its roller 32 was in its second location 48, the second switch attempted to close. This attempt to close the second switch rotates the crank 18 clockwise, placing the link 26 in tension. As previously noted with respect to the more general embodiment of the present invention, tension in the link 26 is unable to move the roller 36 along the path 54 with the consequent result that the second switch cannot close. The tension in the link 26 also, however, firmly seats the roller 32 in the detent notch 93 as it attempts to rotate the yoke 68 counterclockwise. If the tension in the link 26 is relieved, as will be the case when the operating mechanism for the second switch does not subject its switch to a continued attempt at closure, reopening of the first switch results in the link 22 and the roller assuming the location shown in FIG. 1. However, and referring to FIG. 7, if the second switch is subjected to a continued attempt at closure by its operating mechanism, the tension on the link 26 persists and the roller 32 remains firmly seated in the detent notch 93. As a consequence, should the first switch reopen while the second switch continues to be subjected to attempted closure, the roller 32 remains at its second location 48 in the detent notch 93. Accordingly, the reopening of the first switch reciprocates the link 22 leftwardly and permits the link 22 to move relatively to the pin 34 due to the slot 96. Since the length of the slot 96 is sufficiently long to permit full opening of the first switch, and because the right end of the slot 96 does not contact the pin 34, upon full opening of the first switch the tension of the link 26 continues to maintain the roller 32 in the notch 93. Indeed, when the roller 32 is in the notch 93, the link 26 and the yoke 68 form an over-toggle combination which prevents the extended spring 85 from pulling the roller 32 out of the notch 93. These conditions will obtain and the second switch will not be able to close until the tension in the link 26 is first relieved. Relief of this tension may, of course, be effected by "backing off" the switch operating mechanism associated with the second switch. Once the tension in the link 26 is relieved, the force of the extended spring 85 is sufficiently strong to return the roller 32 to its first location 46, as shown in FIG. 1. In a similar fashion, if the first switch is subjected to a continued attempt at closure while the second switch is closed, the second switch may freely open and close thereafter, but the first switch will remain open until tension in the link 22 is relieved.

The next specific preferred embodiment of the present invention relates to the operation of the notch 92, to the asymmetric connection of the bias link 82 to the yoke 68, and to the slightly higher position of the first location 56 with respect to the first location 46. All of these features cooperate to selectively ensure that if both switches attempt to close simultaneously, a selected one of them, namely, the first switch, will close while the second switch remains open.

Figure 8:
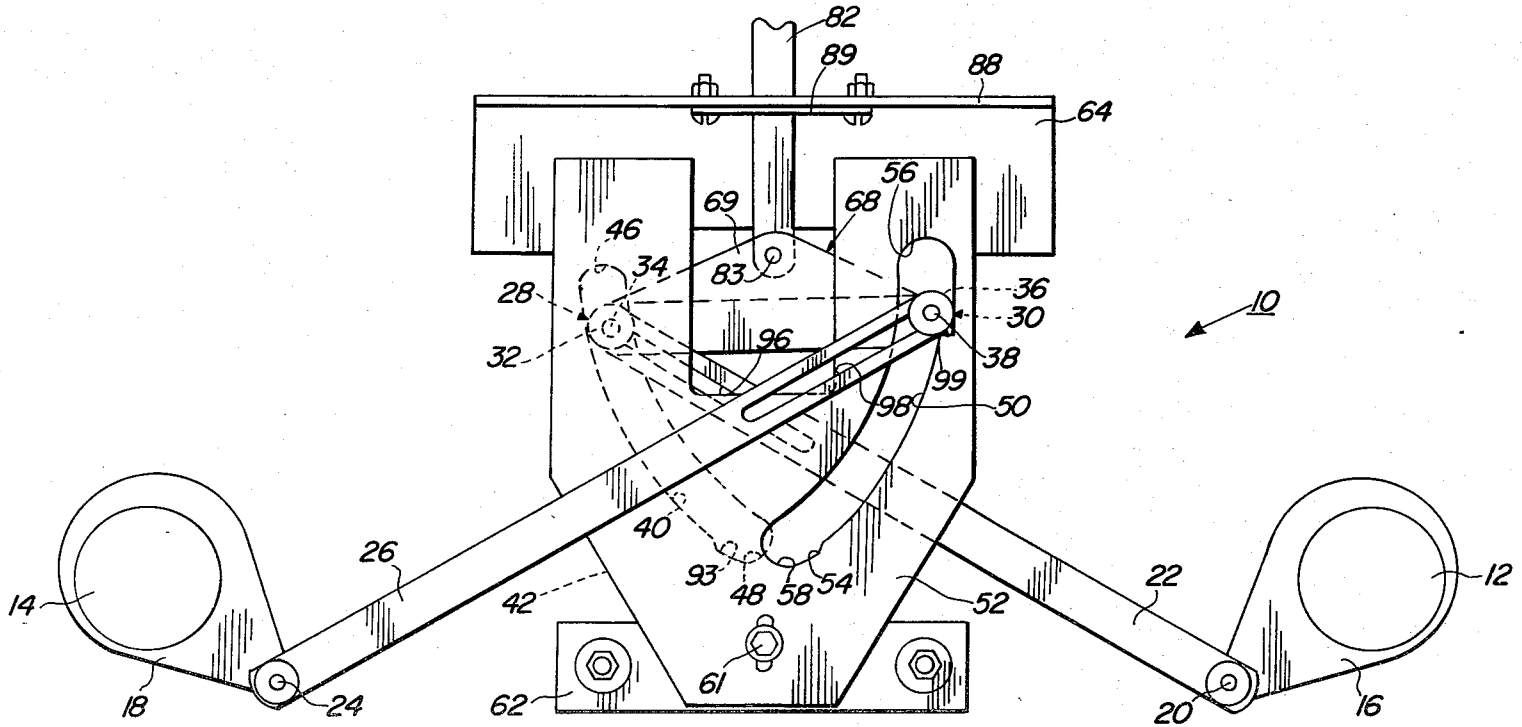

As noted previously, the diameter of the rollers 32 is only slightly less than the width of the tracks 40 and 50. Thus, the placement of the notch 92 in one track 50 increases the width of that track at the first location 56 of the path 54. Movement of the roller 36 from its first location 56 to its second location 58, while the roller 32 in its its first location 46, is accompanied by tension in the link 26. Thus, the notch 92 normally plays no part in the movement of the roller 36 which is pulled against the inner wall of the track 50 by this tension. Assume now, however, that both switches attempt to close simultaneously. Both links 22 and 26 are placed in tension and both attempt to move the right and left ends of the yoke 68 downwardly at the same time. After a slight amount of downward movement, the tracks 40 and 50 are unable to accommodate the rollers 32 and 36 because the distance between the paths 44 and 54 is decreasing while the distance between the rollers 32 and 36 is fixed by the yoke 68. As shown in FIG. 8, movement of the roller 32 downwardly in its track 40 moves the roller 36 to the right of the track 50 so that when both rollers 32 and 36 have moved a slight amount downwardly, the roller 36 engages a ledge 99 of the notch 92 and is thereafter unable to experience further downward movement. Accordingly, with the roller 36 held in the notch 92 by the ledge 99 thereof, the roller 32 continues its downward movement in its tracks 40, pivoting about the pin 38 as before. Thus, the notch 92 preferentially ensures that if both switches attempt simultaneous closure, the first switch closes, while the second switch remains open. Return of the roller 32 to the first location 46 by the reopening of the first switch is accompanied by the same operation as previously described. Specifically, if prior to the reopening of the first switch tension in the link 26 is relieved, reopening of the first switch results in both switches being open and capable of closing. If, on the other hand, the second switch is subjected to a continued attempt at closure while the first switch is closed and through the time it reopens, the roller 32 remains locked in the detent 93 by the tension of the link 26 and by the overtoggle action of the link 26 and the yoke 68.

The asymmetric connection of the bias link 82 to the yoke 68, and the slightly higher position of the first location 56 relative to the second location 46, aid in ensuring that, during an attempt at simultaneous closure of the switches, the first switch closes while the second switch remains open. Specifically, as noted previously, the bias link 82 is connected to the yoke 68 via the pin 83, which is slightly closer to the pin 38 than it is to the pin 34. Thus, the lever arm between the pin 83 and the pin 34 is slightly longer than the lever arm between the pin 83 and the pin 38. Accordingly, should roughly equal tension forces be applied to the links 22 and 26, the pin 34 moves downwardly slightly faster than the pin 38 due to the greater force applied to the left side of the yoke 68 relative to the pin 83 than is applied to the right side of the yoke 68. This slightly asymmetric connection of the pin 83 to the yoke 68 helps ensure that the roller 36 is engaged by the ledge 99 of the notch 92. Further, and as depicted in FIG. 1, because the first location 56 is slightly higher than the first location 46, the roller 32 gets a "head start" in its downward movement in its track 40 relative to the downward movement of the roller 36 in its track 50. This ensures that the roller 32 always has a lower location than the roller 36, if both links 22 and 26 are simultaneously tensioned equally, and that the roller 36 engages the ledge 99 preventing further downward movement thereof while allowing downward movement of the roller 32 to its second location 48. The spring 85 is selected and the position of the stop pin 91 is so chosen that the rollers 32 and 35 are located in their first locations 46 and 56 when both switches are open. This ensures that the roller 32 gets the above-described "head start."

Reference to FIGS. 1–4 shows that the apparatus 10 is quite compact and thin. This compactness is in great part achieved by the close positioning of the plates 42 and 52 with the yoke 68 therebetween. Thus, except for the links 22 and 26, which must necessarily interconnect the cranks 16 and 18 with the rollers 32 and 36, the apparatus is quite compact and may be located in a confined space of the switchgear enclosure.

I claim:

1. A high-voltage switchgear having first and second two-position switches, apparatus for preventing the switches from simultaneously occupying their second positions, which apparatus comprises:

a first driven member;

first means for constraining the first driven member to move along a first curvilinear path between extreme first and second locations;

a first link associated at a first end with the first switch for reciprocation of a second end thereof in a first direction when the first switch moves from its first to its second position and in a second opposite direction when the first switch moves from its second to its first position, the first switch being unable to move if the first link is prevented from moving;

first means for connecting the second end of the first link to the first driven member so that when the first switch moves from its first to its second position, the first link and its second end reciprocate in the first direction to move the first driven member from its first to its second location, and so that when the first switch moves from its second to its first position, the first link and its second end reciprocate in the second direction;

a second driven member;

second means for constraining the second driven member to move along a second curvilinear path between extreme first and second locations;

a second link associated at a first end with the second switch for reciprocation of a second end thereof in a third direction when the second switch moves from its first to its second position and in a fourth opposite direction when the second switch moves from its second to its first position, the second switch being unable to move if the second link is prevented from moving;

second means for connecting the second end of the second link to the second driven member so that when the second switch moves from its first to its second position, the second link and its second end reciprocate in the third direction to move the second driven member from its first to its second location, and so that when the second switch moves from its second to its first position, the second link and its second end reciprocate in the fourth direction; and yoke means for maintaining the driven members a fixed distance apart so that both driven members can simultaneously occupy their first locations, either driven member can occupy its second location while the other driven member occupies its first location, and either driven member is prevented from moving out of its first location while the other driven member is not in its first location;

whereby both switches can simultaneously occupy their first positions, either switch can move to and occupy its second position while the other switch is in its first position, and neither switch can move out of its first position, despite a momentary or continued attempt to so move, while the other switch is not in its first position.

2. Apparatus as in claim 1, wherein movement of one switch from its second to its first position reciprocates its associated link and the respective second end thereof in the second or fourth direction and the respective connecting means simultaneously moves the associated driven member from its second to its first location, notwithstanding a momentary or a continued attempt of the other switch to move from its first to its second position, a continued attempt of the other switch to so move resulting in its movement to its second position after the one switch reaches its first position.

3. Apparatus as in claim 1, wherein each connecting means further comprises means responsive to both movement of its associated switch from the second to the first position and reciprocation of its link and the respective second end thereof in the second or fourth direction for either moving the associated driven member to its first location in the absence of a continued attempt of the other switch to move from its first to its second position or for holding the associated driven member in its second location while permitting relative motion between the held driven member and its associated link in the presence of a continued attempt of the other switch to move from its first to its second position.

4. Apparatus as in claim 1, 2 or 3, which further comprises means responsive to an attempt of both switches to move from their first to their second positions for preventing a selected one of the driven members from moving out of its first location while permitting the other driven member to move to its second location.

5. Apparatus as in claim 1, wherein:

each first and second driven member is a roller rotatable on a pin;

each first and second constraining means is a plate having therethrough a curvilinear track in which a respective one of the rollers moves;

each link is an elongated member;

each first and second connecting means connects a respective one of the pins to a respective one of the links; and the yoke means holds the pins the fixed distance apart.

6. Apparatus as in claim 5, wherein:

each link is put in tension when its associated switch attempts to move from the first to the second position;

each link is put in compression when its associated switch attempts to move from the second to the first position;

the plates are mounted together in a spaced apart, overlying relationship so that, as viewed normal to the tracks, the first locations are separated by the fixed distance and the second locations are adjacent; and each path, which is the centerline of its track, is a portion of a circle having as a center the first location of the other path.

7. Apparatus as in claim 6, wherein each link has a longitudinal slot beginning near its second end for receiving its respective pin so that relative motion between the link and both the pin and the roller may occur when the pin and the roller are in the second location and so that each switch may move between its first and second positions even though its associated roller cannot move out of its second location; and which further comprises biasing means connected to the yoke means for biasing the rollers toward their respective first locations.

8. Apparatus as in claim 7, wherein each track contains a detent notch at its second location; and the links, the slots therein, the yoke means and the detent notches are related so that (a) movement of one switch from the first to the second position while the other switch is in its first position causes the slot in the tensioned link associated with the one switch to engage the pin therein and move the roller thereon from the first to the second location, (b) movement of one switch from the second to the first position while the other switch is in its first position (i) causes the slot in the compressed link associated with the one switch to move relative to the pin therein and the biasing means to concurrently move the roller on the pin to the first location, if the link associated with the other switch is not tensioned, or (ii) causes the roller associated with the one switch to be seated in its detent notch and prevents the seated roller from moving out of the second location as the compressed link associated with the one switch moves relative thereto, if the link associated with the other switch is tensioned, the biasing means being unable to move the seated roller out of the detent notch and back to the first location until the tension is relieved.

9. Apparatus as in claim 8, wherein when the roller associated with one switch is seated in its detent notch by tension in the link associated with the other switch, the tensioned link and the yoke means are in over-toggle.

10. Apparatus as in claim 8, which further comprises a widened portion in one track with a ledge near the first location, a simultaneous attempt of both switches to move from their first to their second locations causing the roller in the one track to abut the ledge and cease movement as the other roller moves to the second location.

11. In high-voltage switchgear having first and second two-position switches, apparatus for preventing the switches from simultaneously occupying their second positions, which apparatus comprises:

a first link, a first end of which moves with the first switch to reciprocate the first link to move a second end of the first link, the first switch being unable to move if the second end of the first link cannot move;

a second link, a first end of which moves with the second switch to reciprocate the second link to move a second end of the second link, the second switch being unable to move if the second end of the second link cannot move;

means for constraining the second end of each link to move along respective curvilinear paths from a first location, whereat the respective switch is open, to a second location, whereat the respective switch is closed;

means for maintaining the second ends of the links a fixed distance apart so that (a) the second ends of the links may simultaneously occupy their respective first locations and (b) the second end of either link can occupy its first location while the second end of the other link occupies its second location but (c) if the second end of either link is not in its first location, the second end of other link cannot move out of its first location.

12. Apparatus as in claim 11, which further comprises means responsive to an attempt of the second ends of both links to simultaneously move out of their first locations for holding the second end of a selected one of the links near its first location while permitting the second end of the other link to move to its second location.

* * * * *